United States Patent [19]

Runac

[11] 4,057,981

[45] Nov. 15, 1977

[54] VENTILATED CUSHION FOOT SOCK AND METHOD

[75] Inventor: John J. Runac, New York, N.Y.

[73] Assignee: Crescent Hosiery Mills, Niota, Tenn.

[21] Appl. No.: 746,841

[22] Filed: Dec. 2, 1976

[51] Int. Cl.[2] ..... D04B 9/46; A41B 11/02

[52] U.S. Cl. ..... 66/185

[58] Field of Search ..... 66/185, 186, 187, 180, 66/178 R, 169, 170

[56] References Cited

U.S. PATENT DOCUMENTS

| | | | |
|---|---|---|---|
| 668,674 | 2/1901 | Brown | 66/180 |
| 743,231 | 11/1903 | Blood | 66/180 |
| 1,136,097 | 4/1915 | Cahn | 66/185 |
| 1,791,405 | 2/1931 | Fichtner et al. | 66/182 |
| 1,936,038 | 11/1933 | Schindler | 66/185 |
| 2,031,432 | 2/1936 | Sickerott | 66/187 |
| 2,086,820 | 7/1937 | Quinn | 66/185 |
| 2,130,018 | 9/1938 | Lockhead | 66/185 |
| 2,144,563 | 1/1939 | Davis | 66/182 |
| 2,208,300 | 7/1940 | Burd et al. | 66/185 |
| 2,239,593 | 4/1941 | Crawford | 66/185 |
| 2,400,637 | 5/1946 | Fregeolle | 66/182 |
| 3,003,343 | 10/1961 | Alfano | 66/180 |
| 3,078,699 | 2/1963 | Huntley | 66/176 |

FOREIGN PATENT DOCUMENTS

| | | | |
|---|---|---|---|
| 1,003,155 | 2/1957 | Germany | 66/185 |
| 2,604 of | 1889 | United Kingdom | 66/176 |

*Primary Examiner*—Ronald Feldbaum

*Attorney, Agent, or Firm*—Bell, Seltzer, Park & Gibson

[57] ABSTRACT

Terry loops provide a cushion throughout at least the sole portion of the foot of the sock and ventilator panels extend along opposite sides of the sole. The ventilator panels are formed with an open mesh stitch construction to permit the passage of air therethrough and to provide for ventilation of the foot when the sock is worn. Terry loops may also provide a cushion in the instep portion and the ventilator panels may be formed with tuck stitches interspersed with plain stitches.

11 Claims, 3 Drawing Figures

VENTILATED CUSHION FOOT SOCK AND METHOD

This invention relates generally to a ventilated cushion foot sock and method of forming the same and more particularly to such a sock which includes ventilator panels formed of open mesh stitch construction extending along opposite sides of the sole of the sock to permit the passage of air therethrough and to provide for ventilation of the foot when the sock is worn.

It is known to knit terry loops on the inner surface of various portions of the foot of a sock. Cushion foot socks of this type are disclosed in U.S. Pat. Nos. 2,144,563 and 2,400,637. This type socks are usually worn by people participating in some type of athletic event or while exercising and the cushion foot aids in prevention of the formation of blisters and also aids in absorbing perspiration. While the terry loop cushion sole portion of the sock does aid in absorbing perspiration, the sock soon becomes saturated with perspiration and imparts a cold and clammy sensation to the foot of the wearer.

With the foregoing in mind, it is an object of the present invention to provide a ventilated cushion foot sock and method of forming the same wherein ventilator means is provided along opposite sides of the sole and the ventilator means is formed with an open mesh stitch construction to permit the passage of air therethrough and to provide for ventilation of the foot when the sock is worn so that any moisture in the sock may be more readily evaporated.

In accordance with the present invention, the ventilator means takes the form of elongated panels of open mesh stitch construction extending along opposite sides of the sole of the foot and the open mesh stitch construction may take the form of tuck stitches interspersed with plain stitches. The tuck stitches are preferably formed in adjacent pairs and are separated by adjacent pairs of plain stitches to provide ventilator openings in the panels. The elongated ventilator panels each encompass about one-tenth of the total number of wales in the foot portion and extend from closely adjacent the heel pocket to closely adjacent the toe pocket.

The ventilated cushion foot sock of the present invention can be knit on a conventional circular hosiery knitting machine of the type normally used to knit cushion foot socks with only minor modifications being required. The modifications involve only the formation of tuck stitches along opposite sides of the sole portion of the foot of the sock and this type of pattern can be easily set up on the machine.

Figure 1:
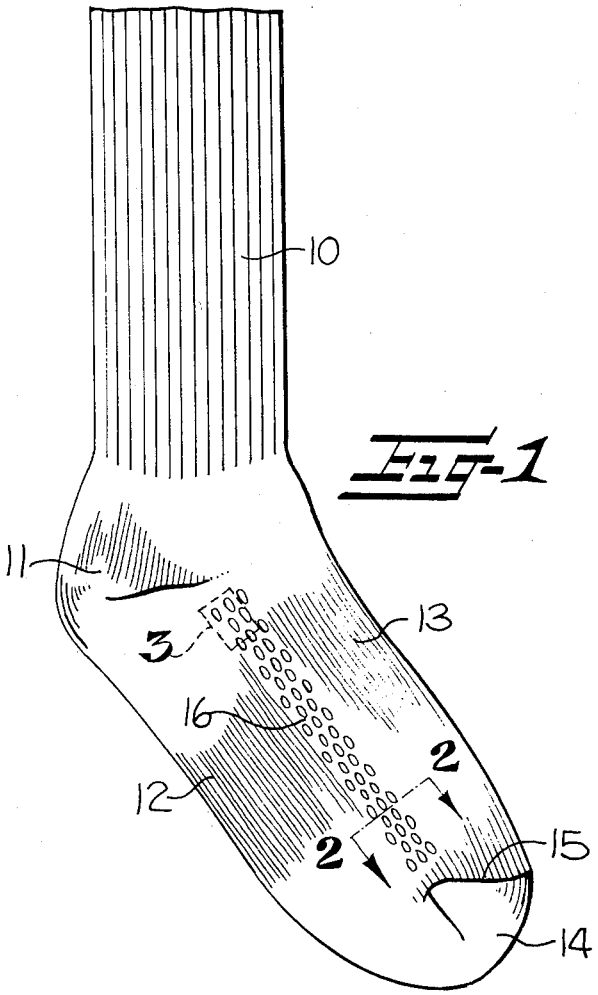
Figure 2:
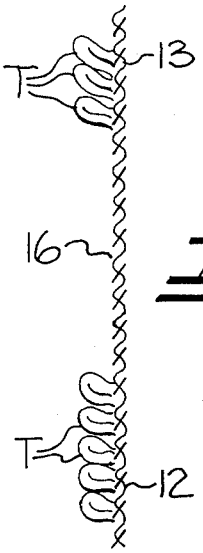
Figure 3:
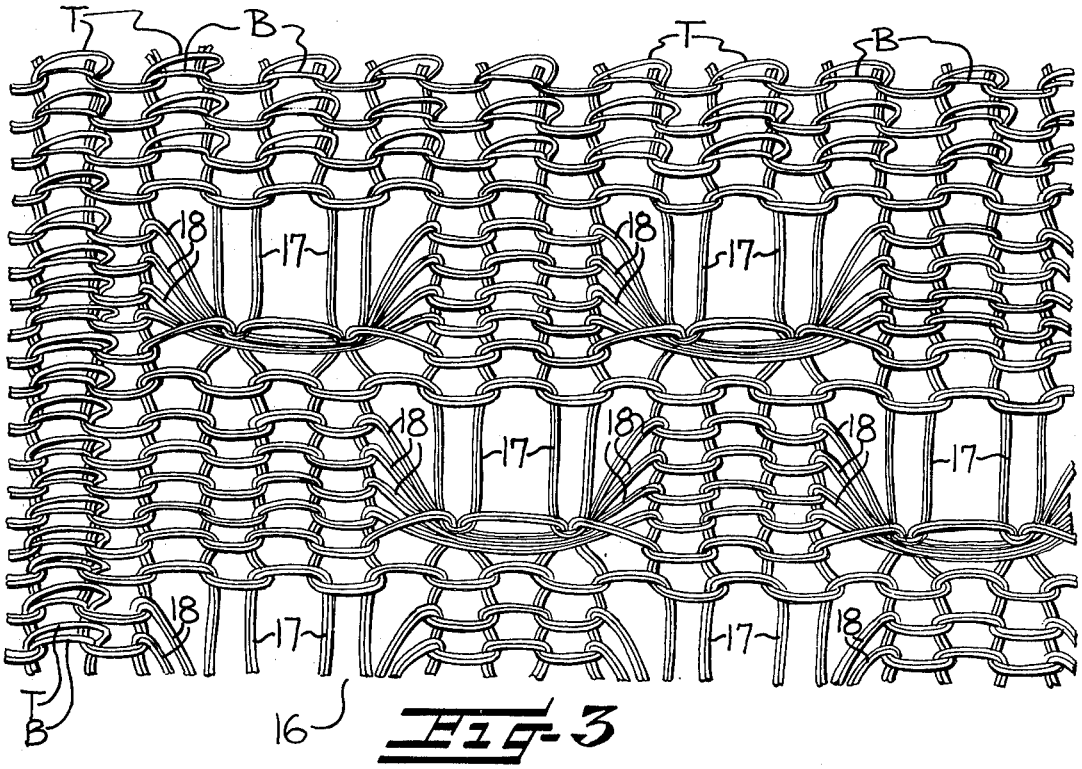

Other objects and advantages will appear as the description proceeds when taken in connection with the accompanying drawings, in which FIG. 1 is a side elevational view of one side of the sock of the present invention, illustrating the elongated ventilator panel extending along one side of the sole, the opposite side of the sock also including an identical elongated ventilator panel of the same length and width as the ventilator panel shown;

FIG. 2 is a somewhat schematic enlarged sectional view taken substantially along the line 2—2 in FIG. 1 and illustrating the manner in which the terry loops extend inwardly from and on opposite sides of the ventilator panel; and FIG. 3 is a greatly enlarged fragmentary view of that portion of the fabric enclosed in the dotted rectangle 3 in FIG. 1 and being taken looking outwardly from the inside of the foot portion of the sock in order to more clearly illustrate the manner in which the inwardly extending terry loops are provided in the area surrounding the ventilator panel and to illustrate the manner in which the tuck stitches are formed.

The sock illustrated in FIG. 1 is of the type generally referred to as an "athletic" sock and includes integrally knit leg and foot portions with the leg portion comprising a mock rib cuff 10 which extends throughout substantially the entire length of the leg and may be provided with horizontal stripes of different colors, if desired. The foot portion includes a reciprocatorily knit fashioned heel pocket 11, a sole portion 12 extending beneath the foot, an instep portion 13 extending over the top of the foot, and a reciprocatorily knit fashioned toe pocket 14. When the knitting of the sock is completed, the toe is open and may then be closed by any suitable means, such as a line of stitching 15.

Ventilator means extends along opposite sides of the sole 12 and comprises elongated ventilator panels 16, only one of which is shown in FIG. 1, which are formed with an open mesh stitch construction to permit the passage of air therethrough and to provide for ventilation of the foot when the sock is worn. Terry loops, indicated at T in FIG. 3, extend inwardly of and throughout at least the sole portion 12 and preferably throughout the heel 11, toe 14 and instep 13. The terry loops T are formed in the usual manner with the body yarn B being fed below the nebs of the sinkers and the terry yarn being fed above the nebs of the sinkers. The terry yarn is knit in plated relationship with the body yarn B in each of the needle wales and the terry yarn forms inwardly extending terry loops T in the sinker wales.

As best illustrated in FIG. 3, the open stitch construction provides ventilator openings in the ventilator panel 16 to permit a greater amount of air to pass therethrough than in the plain knit sole portion 12 and instep portion 13. The open mesh stitch construction includes tuck stitches interspersed with plain stitches and, as illustrated in FIG. 3, adjacent pairs of tuck stitches are separated by adjacent pairs of plain stitches. Also, the wales in which the pairs of tuck stitches are formed are staggered in a coursewise direction to provide an attractive pattern of openings in the fabric. The tuck stitches are formed with adjacent pairs of held stitch loops 17 and four tuck loops 18 which extend from the plain stitches on opposite sides of the held stitches 17 and pass downwardly beneath the held stitches 17. These tuck stitches are formed in the usual manner by initially drawing stitch loops and holding these stitch loops on the needles while additional yarns are fed to the needle hooks but these needles are not raised to shed level so that tuck loops are formed and held in the hooks of the needles until both the held loops 17 and the tuck loops 18 are shed from the needles with the formation of the next plain stitch loops.

The sock illustrated is of the type knit on a machine containing 108 needles so that the needle wales are provided in the leg and foot portions of the sock. Although the invention is not limited to the use of a particular type of ventilator panel 16 in the foot of the sock, it has been found that a ventilator panel ten wales wide is satisfactory to permit the passage of air therethrough and to provide for ventilation of the foot when the sock is worn. Since each ventilator panel is ten wales wide, they each comprise approximately one-tenth of the total number of wales in the foot portion. It is preferred that the sole portion encompass 54 wales and that the instep portion encompass 34 wales so that the sole portion 12 is wider than the instep portion and the ventilator panels 16 extend from a point closely adjacent the heel pocket 11 to a point closely adjacent the toe pocket 14. The inwardly facing tuck loops T positioned on opposite sides of the ventilator panels 16 (FIG. 2) aid in preventing the ventilator panels 16 from being directly engaged throughout their width against the foot of the wearer so that air can more easily pass therethrough than would be the case if the ventilator panels were in direct contact with the foot of the wearer.

METHOD OF KNITTING

The sock of the present invention is preferably knit from top to toe. After the usual make-up is formed, the mock rib cuff portion 10 is knit by feeding an elastic yarn to the needles and inlaying the same in a 1 × 3 manner while plain stitch loops are knit with a body yarn to form the mock rib cuff. At the lower end of the cuff 10 the elastic yarn is withdrawn and inwardly extending terry loops are formed in complete circular courses to form a few leg courses above the heel pocket 11. The heel pocket 11 is then formed by moving substantially half of the needles to a raised or inactive position and knitting partial courses while gradually decreasing the number of active needles in a narrowing operation and then gradually increasing the number of active needles in a widening operation to form gore lines extending along opposite sides of the heel pocket 11.

The sole 12, instep 13 and ventilator panels 16 are then formed with continuous rotation of the needle cylinder and with all needles in active position. Terry loops T are formed in the sole portion 12 and the instep 13 while a tuck stitch open mesh construction is knit in the ventilator panels 16 at opposite sides of the sole 12. In the ventilator panels 16 adjacent pairs of needles form the held loops 17 and the tuck loops 18 while adjacent pairs of plain stitch loops are formed therebetween, as illustrated in FIG. 3.

The machine then switches to reciprocatory knitting and the toe pocket 14 is formed on approximately half of the needles while the other needles are maintained in an inactive position. Narrowed and widened partial courses are formed on the active needles to complete the toe 14 and form gore lines extending along opposite sides of the toe pocket 14. The machine then switches to rotary knitting to form a few complete courses, known as loopers rounds. After knitting of the sock is completed, the toe is closed by a looper or seam line 15 while the loopers rounds are cut off.

While a particular type of sock has been illustrated in the drawings, it is to be understood that the ventilator means of the present invention could be provided in other types of hosiery articles. Also, the ventilator panels may be provided with other types of open mesh stitch construction and the invention is not limited to the particular type of tuck stitches illustrated in the drawings. The open mesh stitch construction extending along opposite sides of the sole portion of the sock permits the passage of air therethrough and provides for ventilation of the foot when the sock is worn so that any perspiration absorbed by the terry loops in the cushion sole can be more easily evaporated by the air passing through the ventilator panels.

In the drawings and specification there has been set forth a preferred embodiment of the invention, and although specific terms are employed, they are used in a generic and descriptive sense only and not for purposes of limitation, the scope of the invention being defined in the claims.

That which is claimed is:

1. A sock including integrally knit leg and foot portions, said foot portion comprising a heel, a sole encompassing substantially half of the wales of said foot portion, an instep encompassing at least one-fourth of the wales of said foot portion and a toe, terry loops extending inwardly of and throughout at least said sole, terry loops extending inwardly of and throughout said instep, and elongate ventilator panels extending along opposite sides of said sole, said elongate ventilator panels having opposite ends contiguous with said heel and toe, having lower sides contiguous with said terry loops of said sole, and having upper sides contiguous with said terry loops of said instep, said ventilator panels comprising an open mesh stitch construction of open stitches interspersed with plain stitches to permit the passage of air therethrough and to provide for ventilation of the foot when the sock is worn.

2. A sock according to claim 1 wherein said open mesh stitch construction in said ventilator panels comprises tuck stitches interspersed with plain stitches

3. A sock according to claim 2 wherein said tuck stitches comprise adjacent pairs of tuck stitches with adjacent pairs of plain stitches separating said adjacent pairs of tuck stitches.

4. A sock according to claim 3 wherein each of said tuck stitches comprises a held loop and more than two tuck loops extending beneath said held loop.

5. A sock according to claim 4 wherein four tuck loops extend beneath said held loop.

6. A sock including integrally knit leg and foot portions, said foot portion comprising a heel, a sole encompassing substantially half of the wales of said foot portion, an instep encompassing at least one-fourth of the wales of said foot portion, and a toe, terry loops extending inwardly of and throughout at least said sole, and rectangular elongate ventilator panels extending along opposite sides of said sole, said ventilator panels having lower sides contiguous with said terry loops of said sole and upper sides contiguous with said instep, said ventilator panels comprising an open mesh stitch construction of open stitches interspersed with plain stitches to permit the passage of air therethrough and to provide for ventilation of the foot when the sock is worn, each of said ventilator panels extending only from said heel to said toe.

7. A sock according to claim 6 wherein each of said ventilator panels comprises approximately one-tenth of the total number of wales in said foot portion.

8. A method of knitting a sock on a circular hosiery knitting machine with rectangular elongate ventilator panels extending along opposite sides of the sole to permit the passage of air therethrough and to provide for ventilation of the foot when the sock is worn, said method comprising the steps of knitting a leg portion with successive complete courses, knitting a heel pocket with partial courses while gradually narrowing and then gradually widening the partial courses, knitting a foot portion with successive complete courses while knitting plain stitch loops in substantially half of the wales to form the sole and forming inwardly extending terry loops throughout the sole, while knitting an open mesh stitch construction of open stitches interspersed with plain stitches and extending from said heel and throughout the length of the sole and along opposite sides of the sole to form the ventilator panels with the lower sides contiguous with the sole, and while knitting plain stitch loops in at least one-fourth of the wales to form the instep with opposite sides contiguous with the upper sides of the ventilator panels, and then knitting a toe pocket.

9. A method of knitting a sock according to claim 8 including the step of forming inwardly extending terry loops in the instep so that terry loops are provided along opposite sides of the ventilator panels extending along opposite sides of the sole.

10. A method of knitting a sock according to claim 8 comprising the step of knitting tuck stitches interspersed with plain stitches to provide the open mesh stitch construction of the ventilator panels extending along opposite sides of the sole.

11. A method of knitting a sock according to claim 8 including the step of forming adjacent pairs of tuck stitches with adjacent pairs of plain stitches separating the adjacent pairs of tuck stitches in the open mesh stitch construction of the ventilator panels extending along opposite sides of the sole.

* * * * *